United States Patent [19]

Combier

[11] Patent Number: 4,748,996

[45] Date of Patent: Jun. 7, 1988

[54] WOVEN MULTILAYERED TEXTILE FABRICS AND ATTENDANT METHOD OF MAKING

[75] Inventor: Charles M. Combier, Aiken, S.C.

[73] Assignee: J. B. Martin Company, Leesville, S.C.

[21] Appl. No.: 12,062

[22] Filed: Feb. 6, 1987

[51] Int. Cl.[4] ..... B32B 5/04; B32B 5/12; B32B 7/08; D03D 11/00

[52] U.S. Cl. ..... 139/415; 2/2; 2/6; 2/7; 2/243 A; 5/483; 139/20; 139/420 R; 139/420 A; 139/420 C; 139/426 R; 156/245; 264/257; 264/324; 264/DIG. 19; 428/109; 428/111; 428/113; 428/114; 428/226; 428/229; 428/232; 428/251; 428/252; 428/257; 428/258; 428/259; 428/284; 428/285; 428/287; 428/298; 428/408; 428/902; 428/920

[58] Field of Search ..... 2/2, 6, 7, 243 A; 5/483; 139/20, 415, 420 R, 420 A, 420 C, 426 R; 428/109, 111, 113, 114, 226, 229, 232, 284, 285, 287, 298, 902, 920

[56] References Cited

U.S. PATENT DOCUMENTS

| | | | |
|---|---|---|---|
| 417 | 12/1856 | McNair | 139/415 |
| 279,042 | 6/1883 | Tarbox . | |
| 761,554 | 5/1904 | Stevenson . | |
| 2,893,442 | 7/1959 | Genin . | |
| 3,045,319 | 7/1962 | Scheel | 139/415 |
| 3,434,508 | 3/1969 | Alterman | 139/20 |
| 3,819,461 | 6/1974 | Saffadi . | |
| 3,914,494 | 10/1975 | Park . | |
| 3,997,697 | 12/1976 | Brochier . | |
| 4,038,440 | 7/1977 | King . | |
| 4,055,697 | 10/1977 | Schmanski . | |
| 4,320,160 | 3/1982 | Nishimura et al. . | |
| 4,365,655 | 12/1982 | Feinberg . | |
| 4,460,633 | 7/1984 | Kobayashi et al. . | |
| 4,499,842 | 2/1985 | Mahr . | |
| 4,536,438 | 8/1985 | Bishop et al. . | |
| 4,581,275 | 4/1986 | Endo et al. | 428/294 |

*Primary Examiner*—James C. Cannon

*Attorney, Agent, or Firm*—Bell, Seltzer, Park & Gibson

[57] ABSTRACT

A woven multilayered textile fabric and attendant method wherein a plurality of layers of the fabric are formed of straight yarns, including at least one layer formed of warp yarns and respective layers formed of filling yarns positioned in superposed relation on opposite sides of the layer of warp yarns and extending at right angles to the warp yarns, and binder warp yarns arranged in cooperating pairs with one binder yarn of each pair extending over certain superposed filling yarns and under certain other superposed filling yarns, and the other binder yarn of each pair being woven oppositely under said certain superposed filling yarns and over said certain other superposed filling yarns.

25 Claims, 4 Drawing Sheets

WOVEN MULTILAYERED TEXTILE FABRICS AND ATTENDANT METHOD OF MAKING

This invention relates to woven textile fabrics and more particularly to multilayered woven textile fabrics wherein a plurality of layers, sometimes termed first, second, and third layers, and other times termed upper, lower and intermediate layers, are provided, all formed of straight yarns, with the first and third layers of straight yarns being filling yarns arranged parallel to each other and with the respective filling yarns arranged in superposed relation with a layer of straight warp yarns extending perpendicularly thereto and positioned between the layers of filling yarns.

Binder yarns are provided for interconnecting the three layers of yarns with the binder yarns being arranged in cooperating pairs so as to maintain the filling yarns in their superposed relation and wherein the binder yarns are preferably of a much smaller size yarn than the yarns forming the various layers so that the woven fabrics may be more readily tailor made for a wide variety of different purposes. For example, certain fabrics of this invention utilize carbon fibers for all the layers so that the fabric may be used as a reinforcement fabric in fiber reinforced plastics, commonly termed composites.

Other fabrics of this invention may have an upper face layer of filling yarns providing an upholstery fabric appearance as by being formed of varicolored yarns and with the underlying layers of yarns being formed of glass fibers, for example, to provide a decorative faced upholstery fabric with fire retardant layers therebehind. Further fabrics of the invention may have one face layer of the fabric formed of yarns of cellulosic fibers such as cotton fibers and the other layers of the fabric having yarns formed of heat resistant and/or high tensile strength fibers so as to provide a fabric for providing wearer comfort as when the fabric is formed into a protective garment with the cellulosic layer forming the inner face of the garment.

An important feature of this invention is the binder warp yarns arranged in cooperating pairs with one binder yarn of each pair extending over certain superposed filling yarns and under certain other superposed filling yarns and the other binder yarn of each pair being woven oppositely under said certain superposed filling yarns and over said certain other superposed filling yarns. These pairs of cooperating binder yarns serve for maintaining the filling yarns in their superposed relationship. Further, this arrangement facilitates obtaining very dense and strong fabrics suitable for a wide variety of uses, some of which as indicated earlier.

It is a further feature of this invention to provide multilayer fabric constructions which even when matrix-free, i.e., free of any thermoplastic material, will readily conform to a variety of different shapes for facilitating the laying up of fabrics into a desired number of layers as in preforming, and in the molding of composites wherein the fabrics are employed as reinforcing media with plastic matrix material. This conformability of the fabrics is bidirectional, i.e., both warpwise and fillingwise, with the yarns of the fabrics essentially shifting and moving relative to each other to readily conform to the desired shape of the object against which the fabric is being placed.

It is a further feature of this invention to provide a novel method of weaving fabrics of this invention.

Briefly stated, this method includes directing a layer of warp yarns into the shed of the loom in a straight path of travel without forming sheds of the warp yarns. During weaving, layers of filling yarns will be positioned on opposite sides of the layer of warp yarns, so as to form upper and lower layers of filling yarns. For interconnecting the upper and lower layers of filling yarns with the intermediate layer of straight warp yarns, binder warp yarns are fed from a source in a positive manner with the binder yarns forming the respective warp sheds during weaving. The positive feed of the binder yarns results in the binder yarns being under substantially no tension so as not to appreciably disturb the desired straight condition of the filling yarns.

BRIEF DESCRIPTION OF THE DRAWINGS

Some of the objects and advantages of this invention having been stated, others will appear when taken in connection with the accompanying drawings, wherein.

Figure 1:
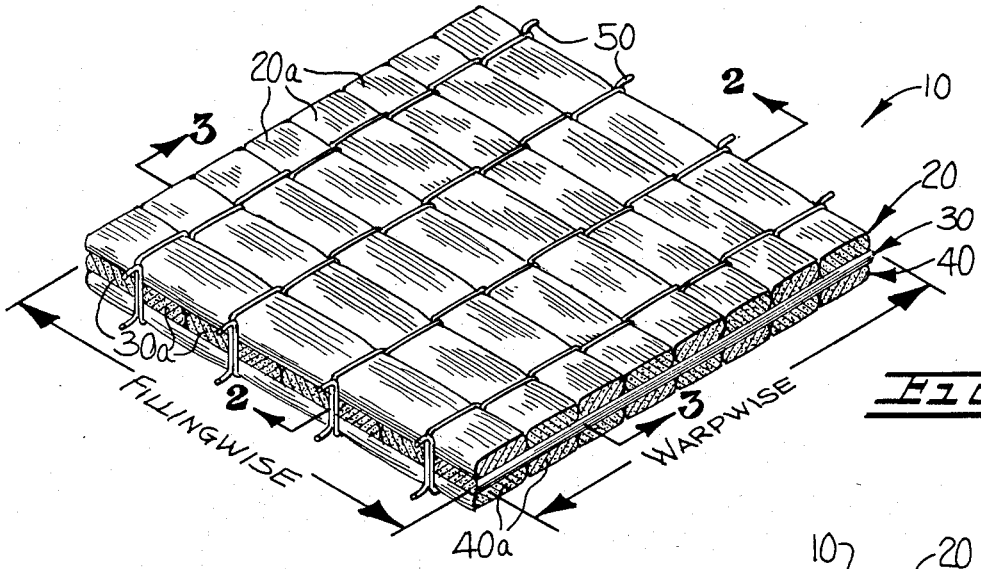
FIG. 1 is a schematic perspective view of a multilayered woven fabric formed in accordance with this invention.
Figure 2:
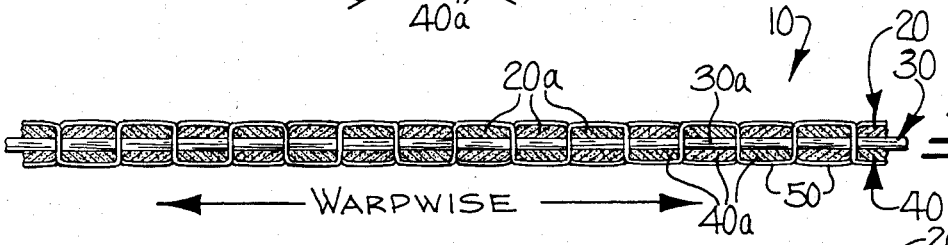
FIG. 2 is a schematic sectional view taken warpwise of the fabric along line 2—2 of FIG. 1.
Figure 3:
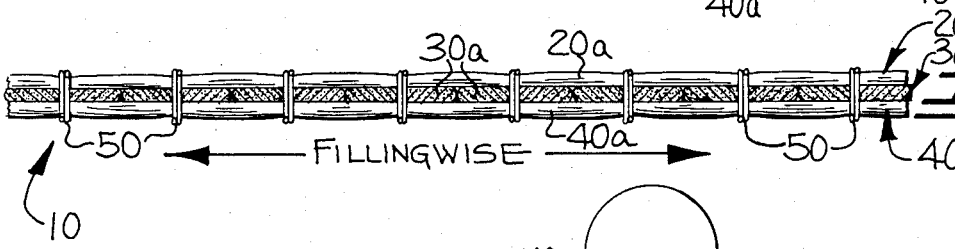
FIG. 3 is another schematic sectional view taken fillingwise of the fabric along line 3—3 of FIG. 1.

Referring now specifically to the drawings, FIGS. 1-3, schematically illustrate a typical multilayered fabric 10 formed in accordance with this invention. As illustrated, the fabric is shown as being of three layered construction having an upper face layer 20 of filling yarns 20*a*, intermediate layer 30 of warp yarns 30*a*, and a lower face layer 40 of filling yarns 40*a*. Binder warp yarns 50, as illustrated, bind all three layers together by being interwoven therewith.

As illustrated, the filling yarns 20*a* forming the upper layer 20 and filling yarns 40*a* forming the lower layer 40 are arranged in superposed relationship and held in this relationship by the warp binder yarns 50. The warp binder yarns 50 are shown (FIG. 4) passing through heddles H and are arranged in cooperating pairs, with the binder yarns of each pair preferably being close together to form a chain stitching type of plain weave construction (FIGS. 1 and 2) with one binder yarn of each pair extending over certain pairs of superposed filling yarns 20*a*,40*a* and under certain other superposed filling yarns. The other binder yarn of each pair is woven oppositely under said pair of superposed filling yarns 20*a*,40*a* and over said certain other superposed filling yarns 20*a*,40*a*. By this arrangement, as noted earlier, the filling yarns are maintained in superposed relationship with each other to aid in providing the desired tightness and density of fabric construction and in facilitating obtaining balanced fabrics, when desired, which are preferred for certain end uses.

As best shown in FIG. 3, the warp yarns 30*a* are arranged in pairs with a cooperating pair of binder yarns 50 extending between each of the pairs of warp yarns 30*a*. It will, of course be understood that instead of having a pair of warp yarns 30*a* between adjacent binder yarns 50 a lesser or greater number of warp yarns may be arranged therebetween.

Various types of fabrics made in accordance with this invention will now be discussed with the significance of the construction to the desired end use of the fabrics.

Of primary importance and a driving force behind this invention coming into being was the need for stronger fabrics formed of carbon fibers and more conformable fabrics so that the fabrics could be used as a reinforcement fabric in fiber reinforced plastics. It is well-known and accepted by those versed in carbon fabrics that the strength of the fabric can be considerably enhanced if the carbon yarns are arranged in the fabrics in a straight manner and not in an undulating or sinuous manner. Tests have indicated that fabrics constructed with straight carbon yarns as opposed to undulating yarns have an increased strength of as much as twenty-five percent or more.

Figure 4:
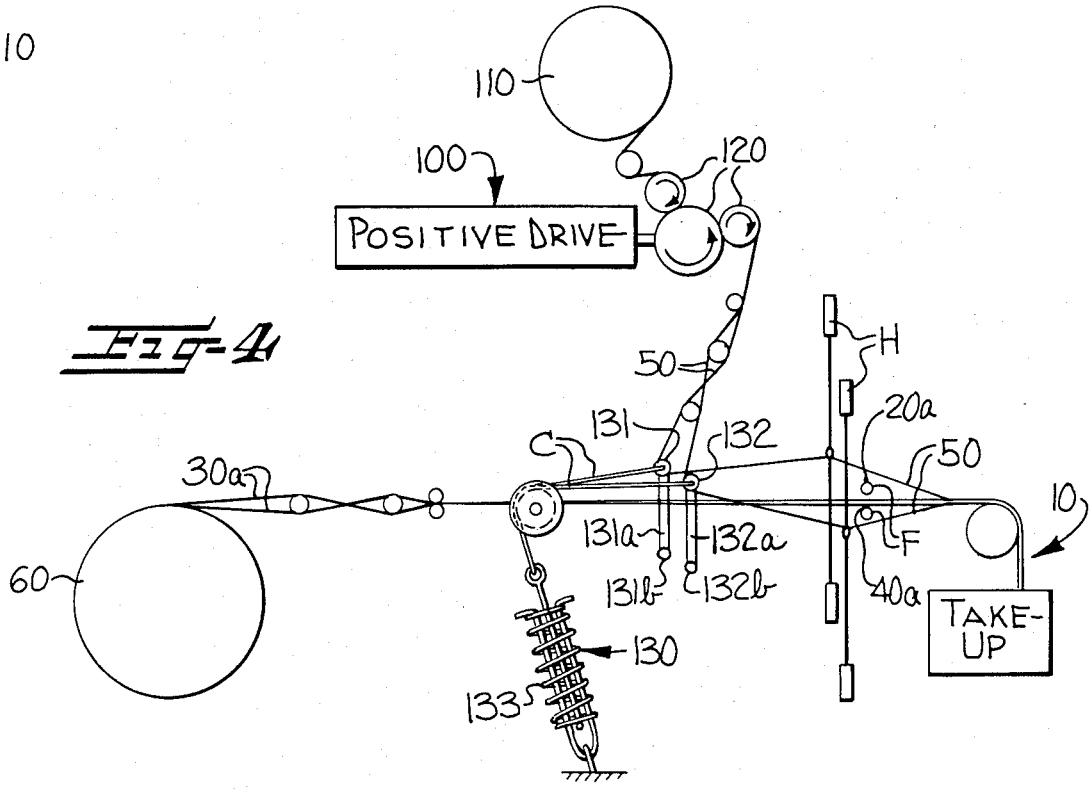
FIG. 4 is a schematic view of a loom for weaving fabrics in accordance with this invention.
Figure 5:
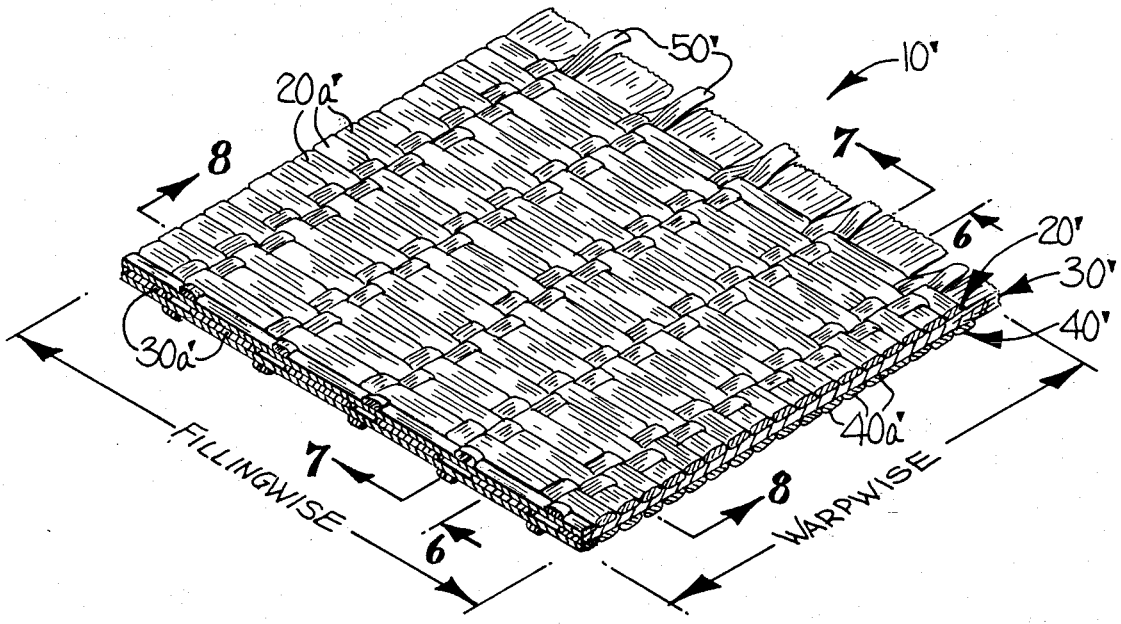
FIG. 5 is a perspective view of a multilayered fabric formed in accordance with this invention and wherein the fabric is illustrated as being of substantially balanced construction.
Figure 6:
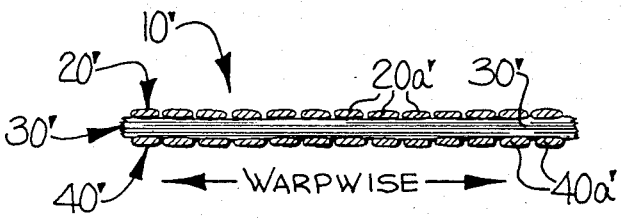
FIG. 6 is a warpwise cross-sectional view of the fabric of FIG. 5 taken substantially along line 6—6 of FIG. 5 and illustrating the substantially straight condition of the warp yarns positioned intermediate the upper and lower face layers formed of substantially straight filling yarns.
Figure 7:
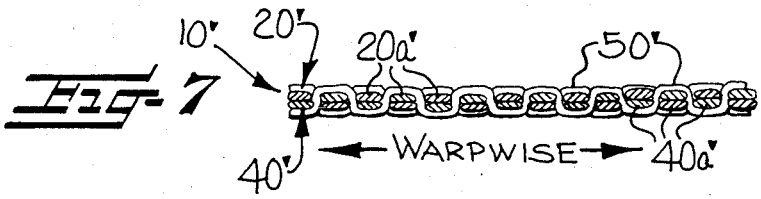
FIG. 7 is another warpwise cross-sectional view taken substantially on line 7—7 of FIG. 5 and illustrating the manner in which the warp binder yarns effect interconnection of the respective layers of the fabric.
Figure 8:
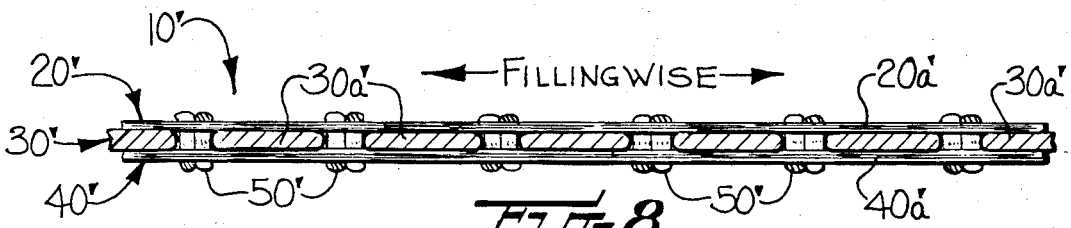
FIG. 8 is a fillingwise cross-sectional view on a somewhat larger scale and taken substantially along line 8—8 of FIG. 5 and illustrating the straight line arrangement of the filling yarns forming the upper and lower face layers of the fabric.

Referring again to FIGS. 1-3, it will be noted that the yarns of all three layers are shown arranged in a straight manner so as to obtain maximum strength of the yarns. Only the binder yarns 50 are undulated since these yarns 50, as noted earlier, are the only yarns that are subjected to the shedding operating during the weaving of the fabric on the loom. The warp yarns 30*a* which form the intermediate layer 30 of the fabric are desirably fed from a common warp beam 60 through the shedding zone of the loom in a straight manner, as illustrated in FIG. 4. Further, the filling yarns 20*a* forming the upper layer 20 of the fabric and the filling yarns 40*a* forming the lower layer 40 of the fabric are also placed in the fabric in a straight manner by filling inserters F, which may be upper and lower shuttles or rapiers.

In order to maintain the filling yarns in their straight condition in the fabric, the binder warp yarns 50 are fed in a substantially tensionless condition by a positive drive apparatus 100 from a common binder yarn warp beam 110 through a series of three feed rolls 120 driven by the positive drive 100. To remove excess slack from the binder yarns when the warp shed is closed a compensating device 130 is desirably utilized for resiliently exerting a rearward pull to a pair of lease rods 131,132 around and under which the binder yarns are directed into the shedding zone. A pair of support arms 131*a*,132*a* carry the lease rods 131,132 and are pivoted at their lower ends 131*b*,132*b*. Cords C connect the opposite ends of the lease rods 131,132 to an anchored resilient device 133 of the compensator 130. This compensator device 130 is conventional equipment on some types of looms and no purpose is seen in going into further details thereof. Also, the positive drive apparatus 100 is typically used for feeding various types of yarn on some types of looms and accordingly, no purpose is seen in commenting further on such drive arrangement.

It will be understood that the positive drive apparatus 100 for the binder yarns 50 presents the binder yarns forwardly in a substantially tensionless condition and thereby avoids any appreciable tension being placed on the binder yarns so as to insure that the binder yarns do not disturb the straight line condition of the filling yarns 20*a* and 40*a* forming the respective upper and lower layers 20 and 40 of the fabric.

It will thus be understood that when strong yarns are utilized for forming all three layers of the fabric, as illustrated in FIGS. 1-3, and strong yarns for the binder yarns 50, that a very strong fabric is provided which is ideally adapted to be used as a reinforcement fabric in fiber reinforced plastics, which the trade commonly terms as composites. Fabrics made to date include balanced strength fabrics wherein the total denier of the warp yarns per inch is substantially equal to the total combined denier per centimeter or inch of said upper and lower layers of filling yarns. In fabrics of this construction wherein all the yarns are carbon, the carbon warp yarns are of a 6K size, i.e. twice the size of filling yarns which are 3K for both layers.

Discussing now other fabrics formed in accordance with this invention, it was realized that very unique fabrics could be obtained by having the opposite faces of the fabric formed of different types of yarns so as to present different characteristics to each face. With this in mind, fabrics were made wherein one face of the fabric and the intermediate layer were made of an aramid yarn such as KEVLAR for strength and resistance to cutting, and the other face of the fabric was made of a cellulosic yarn, such as cotton for comfort as when the fabric is used for protective clothing with the cotton being, of course, innermost of the garment.

Other fabrics were made wherein one face of the fabric and the intermediate layer were formed of an aramid fiber, such as NOMEX, or glass fibers, for high temperature resistance, and the other face was formed of yarns providing an upholstery fabric appearance thereto for a dressy look as the case might be so that the fabrics could be used for fire resistant upholstery.

It was determined that for a wide variety of multilayered fabrics, one layer of the filling yarns and the intermediate layer would desirably be formed of fibers selected from the group consisting of glass fibers, polybenzimidazole fibers, such as PBI manufactured by Celanese Corporation, and aramid fibers, such as KEVLAR or NOMEX manufactured by Dupont Company. The other layer of filling yarns would desirably be formed of a different fiber, such as a cellulosic fiber, such as cotton or yarns providing an upholstery fabric appearance to the multiply fabric.

The binder warp yarns 50 may be formed of a wide variety of fibers including all those mentioned for the filling layers and the intermediate layer of warp yarns.

It was also learned that the insertion of the filling yarns simultaneously produced a better fabric than the successive insertion method. In this regard, it was determined that the filling yarns stayed in their desired superposed relationship much better when simultaneously inserted in the fabric, as is preferred in this invention.

Referring now to the fabric illustrated in FIGS. 5 to 18, this fabric is desirably woven of a balanced construction with the straight warp and straight filling yarns having substantially the same total count or denier of yarns per centimeter. In one fabric construction, Kevlar yarns were used for both the straight warp and straight filling. The warp yarns used were 1500 Denier with 16 ends of warp yarn per centimeter of fabric. The upper and lower filling yarns were each 1,000 Denier with 12 picks of each per centimeter woven into the fabric. Thus, the total warp denier per centimeter was 24,000 denier and the total upper and lower filling denier per centimeter was also 24,000 denier.

While a number of fabrics of this invention have been woven of an unbalanced construction, it was learned that better conformability of the fabrics to a molded shape was usually present when the construction was of a balanced nature. It was further evident that the shape retention or "memory" of the fabric as illustrated in FIGS. 15 to 18 was enhanced where the fabric was of a balanced construction and wherein the fabric was relatively dense as indicated earlier by the relatively large total warp and filling denier per centimeter.

Referring now more specifically to FIGS. 5 to 18, the same reference numerals for the fabric shown therein will be used as in the fabric of FIGS. 1 to 3, with the prime notation added to distinguish from the earlier fabric.

Figure 9:
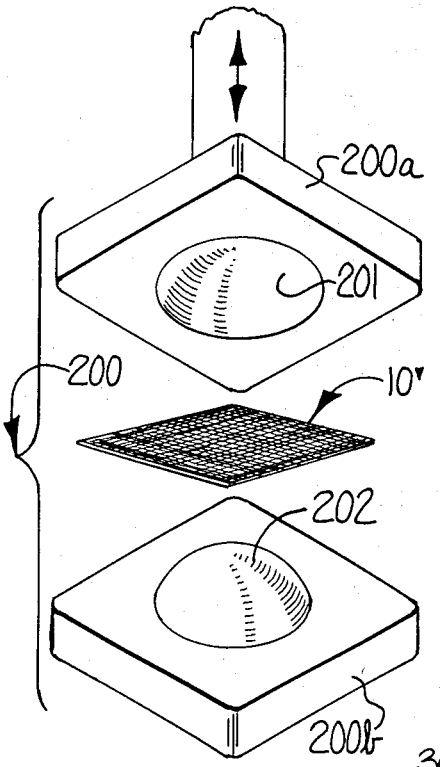
FIG. 9 is a schematic representation of a simple mold with a fabric formed in accordance with the invention interposed between the cooperating upper and lower mold halves.
Figure 10:
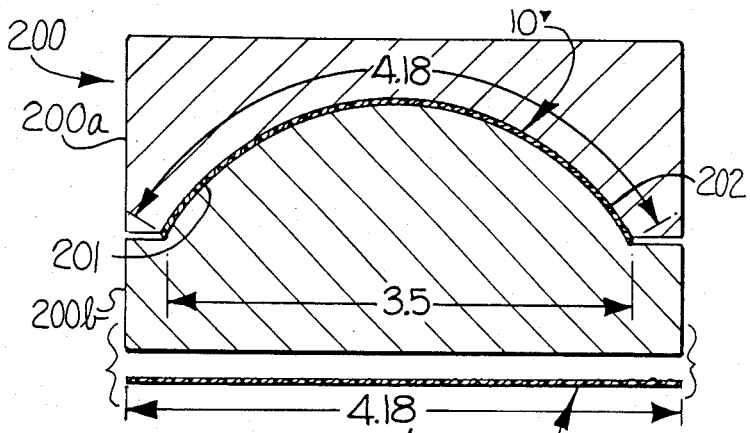
FIG. 10 is a composite schematic view illustrating the flat measured condition of the fabric of FIG. 9 as well as the conformance of the fabric when placed within the mold of FIG. 9 without any matrix.
Figure 12:
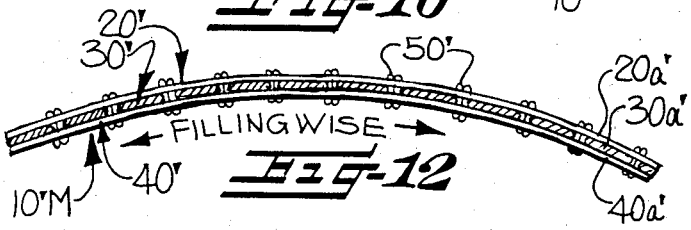
FIG. 12 is a fillingwise cross-sectional view taken substantially along line 12—12 of FIG. 11.
Figure 13:
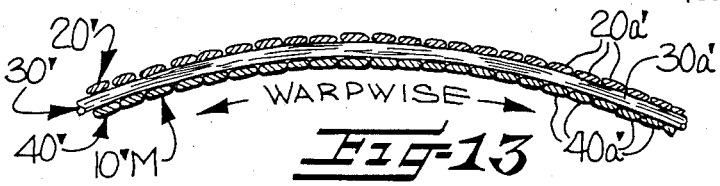
FIG. 13 is a warpwise cross-sectional view taken substantially along line 13—13 of FIG. 11.
Figure 14:
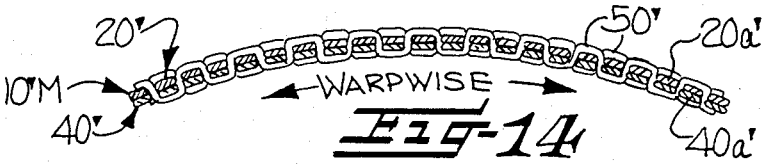
FIG. 14 is a warpwise cross-sectional view taken substantially along line 14—14 of FIG. 11.

Referring now to FIGS. 9 and 10, a mold 200 is schematically shown with an upper female component **200*a* having a concave recess 201 adapted to mate with a dome configuration 202 of a male component 200*b*. As illustrated in FIG. 10 the fabric 10' is molded in mold 200 so as to form a molded fabric 10'M conforming to the dome configuration 202 of the mold, with the yarns of the molded fabric 10'M** suitably sliding and shifting during closing of the mold to avoid any puckering or overlap of the fabric.

Figure 11:
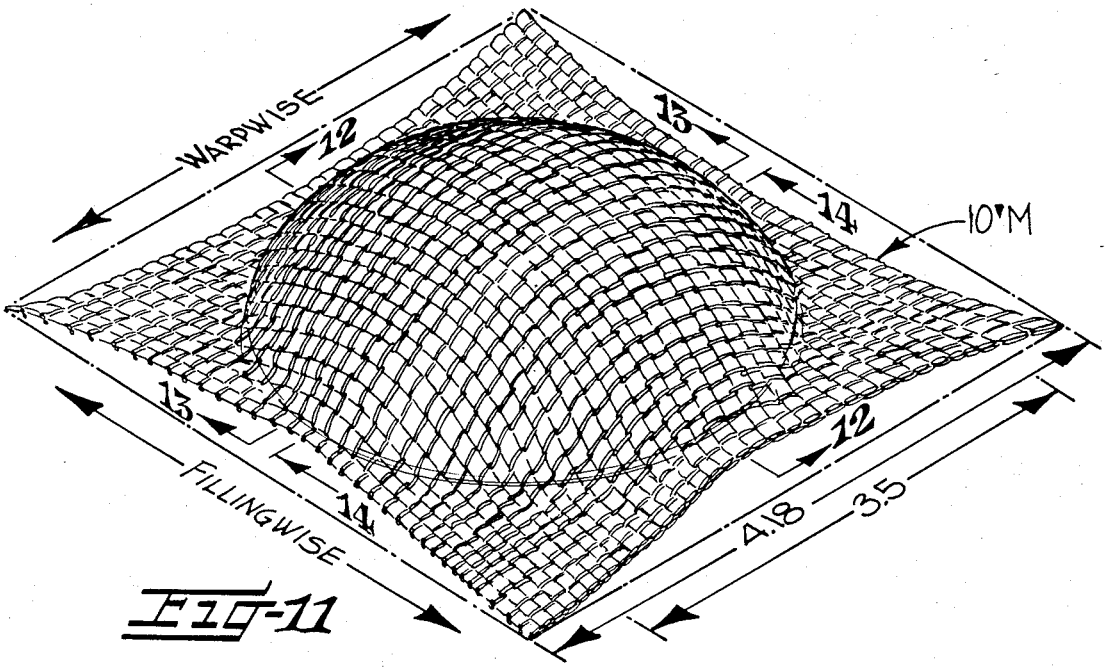
FIG. 11 is a schematic view of the matrix-free fabric of FIG. 10 when removed from the mold and illustrating the manner in which the yarns have shifted relative to each other to conform the shape of the fabric to the shape of the domed mold.
Figure 15:
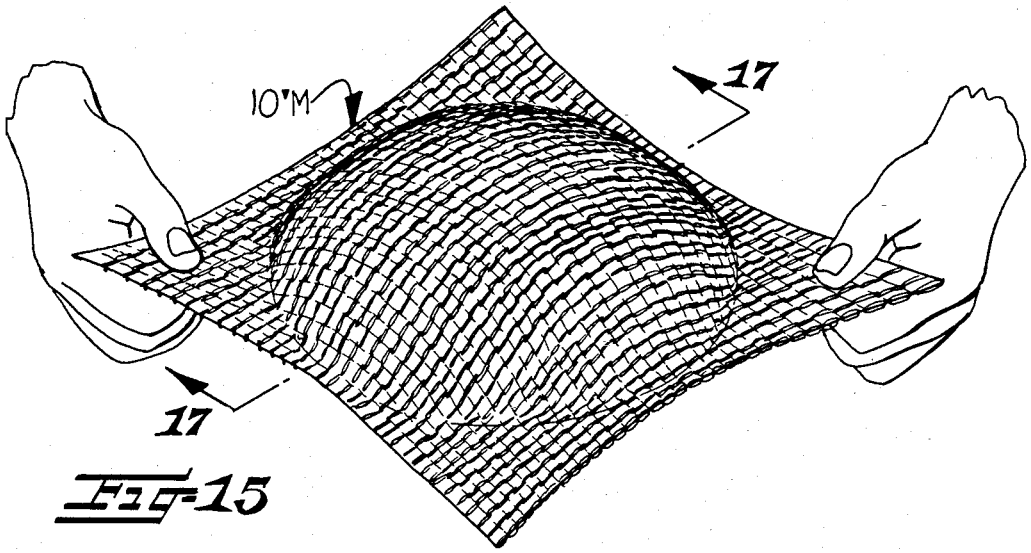
FIG. 15 is another perspective view of the matrix-free molded fabric as illustrated in FIG. 11 being manually held from opposite diagonal corners thereof for the purpose of illustrating the mold memory of the molded fabric and the self-sustaining nature of the molded fabric.
Figure 16:
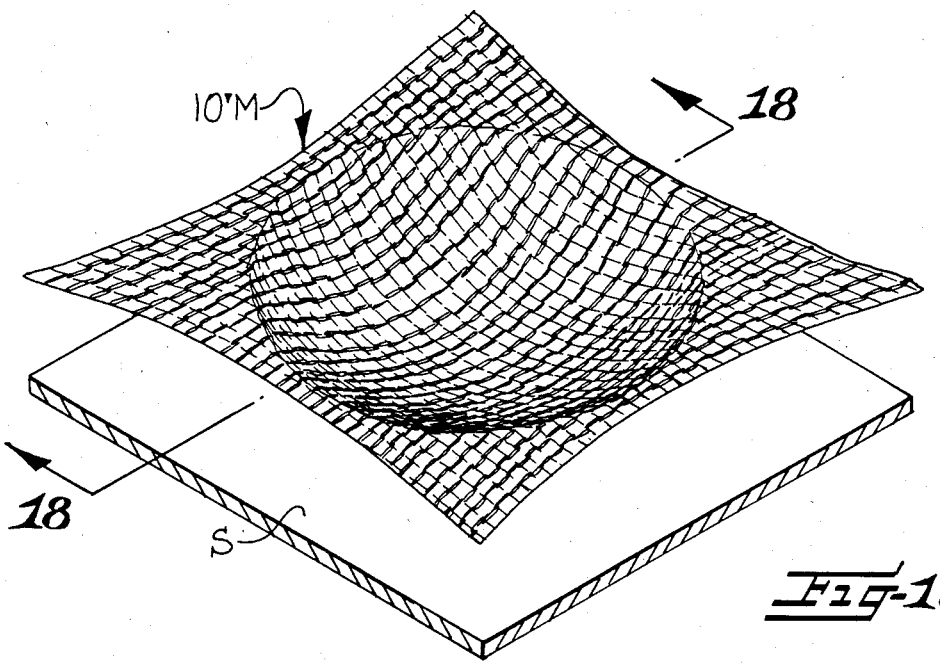
FIG. 16 is another perspective view with the fabric of FIG. 15 turned upside down with the dome thereof being restingly received on a flat surface.
Figure 17:
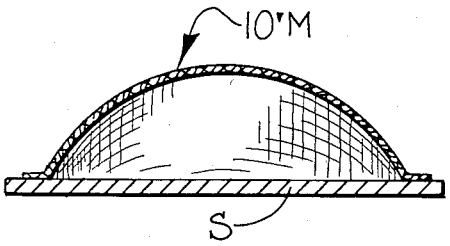
FIG. 17 is a cross-sectional view taken substantially along line 17—17 of FIG. 15 but on a smaller scale and showing the molded fabric resting on a flat surface.
Figure 18:
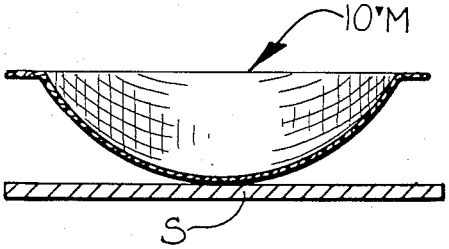
FIG. 18 is another cross-sectional view taken substantially along line 18—18 of FIG. 16 but on a smaller scale and illustrating the molded fabric resting on its dome for the purpose of highlighting the self-supporting nature or memory retention of the matrix-free molded fabric.

FIGS. 11, 15, and 16 best illustrate the repositioning of the yarns of the fabric to impart conformance of the molded fabric 10'M to the mold and the shape retention or "memory" of the fabric so as to permit manual handling of the fabric without appreciably disturbing the molded shape thereof. As illustrated, it will be noted that the warp yarns **30*a*' and upper and lower filling yarns 20*a*', 40*a*' are sinuously arranged to conform to the dome molded into the fabric 10'M. It will further be noted that central side portions of the fabric 10'M have been drawn in further than the corner portions to accommodate the fabric to this particular dome configuration. FIGS. 15 to 18 collectively illustrate the "memory" or shape retention of the fabric 10'M. As illustrated, in FIG. 15, the fabric may be manually handled without appreciably disturbing the shape thereof. Similarly, FIGS. 16 to 18 emphasize the shape retention of the molded fabric 10'M by having the molded fabric resting on a supporting surface S in an upside down attitude (FIGS. 16 and 18) and upright as in FIG. 17**.

As indicated earlier, while shape retention is an important feature where preforming is present, a more important feature of this invention is the ability of the fabric to conform to a desired shape so as to permit the fabric to stay where placed, particularly in the laying up of layers of fabric on each other on a desired shaped mold, for example.

It is thus evident that a wide variety of fabrics may be made in accordance with this invention wherein all of the layers of the fabric may be formed of yarns of the same type of fiber or wherein opposite faces of the fabric are formed of yarns formed of different fibers. Also, it has been seen wherein the warp yarns defining the intermediate layer may also be made of a variety of different fibers including fibers of the type forming one of the face layers such as carbon fibers, glass fibers, aramid fibers, or polybenzimidazole fibers.

In the drawings and specifications, there have been disclosed typical preferred embodiments of the invention and, although specific terms are employed, they are used in a generic and descriptive sense only and not for purposes of limitation, the scope of the invention being set forth in the following claims.

That which I claim:

1. A woven multilayered readily moldable textile fabric having a plurality of layers formed of straight yarns, said plurality of layers including at least one layer formed of straight warp yarns and a pair of layers formed of straight filling yarns positioned on opposite sides of said layer of warp yarns, the respective filling yarns of said pair of layers being in superposed relation and extending at right angles to the warp yarns, and binder warp yarns interconnecting the respective straight warp and filling yarns of said layers, said binder yarns also serving for maintaining said filling yarns in said superposed relation and being arranged in cooperating pairs with one binder yarn of each pair being woven in opposition to the other binder yarn of each pair whereby one binder yarn extends over certain superposed filling yarns and under certain other superposed filling yarns and the other binder yarn of each pair extends under said certain superposed filling yarns and over said certain other superposed filling yarns.

2. A woven multilayered readily moldable textile fabric having a plurality of layers formed of straight yarns, said plurality of layers including at least one layer formed of straight warp yarns and a pair of layers formed of straight filling yarns positioned on opposite sides of said layer of warp yarns, the respective filling yarns of said pair of layers being in superposed relation and extending at right angles to the warp yarns, binder warp yarns interconnecting the respective straight warp and filling yarns of said layers, said binder yarns also serving for maintaining said filling yarns in said superposed relation and being arranged in cooperating pairs and forming chain binder yarns of plain weave construction with one binder yarn of each pair being woven in opposition to the other binder yarn of each pair whereby one binder yarn extends over certain superposed filling yarns and under certain other superposed filling yarns and the other binder yarn of each pair extends under said certain superposed filling yarns and over said certain other superposed filling yarns, and wherein the overall fabric construction is such that the fabic without any pretreatment or after treatment may be manually pressed into intimate engagement with the surface of a variety of different configured objects and conform to the shape thereof and retain such shape after removal from such object so as to permit manual handling of the fabric as in preforming, without appreciably disturbing the conforming shape.

3. A woven multilayered readily moldable textile fabric comprising upper, lower and intermediate layers formed of straight yarns, said upper and lower layers of straight yarns being filling yarns arranged parallel to each other and with the respective filling yarns of the upper and lower layers arranged in pairs, said pairs formed of upper and lower filling yarns in superposed relation, said intermediate layer of straight yarns being warp yarns extending perpendicularly to and between said upper and lower layers of filling yarns, and binder warp yarns interconnecting said upper, lower and intermediate layers of yarns, said binder yarns also serving for maintaining said filling yarns in said superposed relation and being arranged in cooperating pairs with one binder yarn of each pair extending over certain superposed filling yarns and under certain other superposed filling yarns, and the other binder yarn of each pair being woven oppositely under said certain superposed filling yarns and over said certain other superposed filling yarns.

4. A woven multilayered readily moldable textile fabric comprising upper and lower layers formed of straight filling yarns, said upper and lower layers of straight filling yarns being parallel to each other and with the respective filling yarns of the upper and lower layers arranged in pairs, each pair formed of an upper and lower filling yarn in superposed relation, an intermediate layer of straight parallel warp yarns extending perpendicularly to and between said upper and lower layers of filling yarns, and binder warp yarns interconnecting said upper, lower and intermediate layers of yarns, said binder warp yarns also serving for maintaining said filling yarns in said superposed relation and being arranged in cooperating pairs and forming chain binder yarns of plain weave construction with one binder yarn of each pair extending over alternate pairs of superposed filling yarns and under intrevening pairs of superposed filling yarns, and the other binder yarn of each pair being woven oppositely under said alternate pairs of superposed filling yarns and over said intervening pairs of superposed filling yarns.

5. A woven textile fabric according to claims 3 or 4 wherein said intermediate layer of warp yarns is arranged in side-by-side groups of warp yarns, each of a predetermined number, and said pairs of binder warp yarns extend between said groups of warp yarns.

6. A woven textile fabric according to claim 3 or 4 wherein all said layers of straight filling and straight warp yarns are formed of synthetic fibers all of the same composition and wherein said fabric is of balanced construction with the total denier of the warp yarns per centimeter being substantially equal to the total combined denier per centimeter of said upper and lower layers of filling yarns.

7. A woven textile fabric according to claims 3 or 4 wherein said upper and lower layers of filling yarns are formed of the same material so as to provide the same characteristics to opposite faces of the fabric.

8. A woven textile fabric according to claim 7 wherein said upper and lower layers of filling yarn are formed of carbon fibers and said intermediate layer of warp yarns is also formed of carbon fibers so that the fabric is adapted to be used as a reinforcement fabric in fiber reinforced plastics.

9. A woven textile fabric according to claims 3 or 4 wherein all of said straight warp and all said filling yarns are formed of carbon fibers, and said binder yarns are formed of non-carbon fibers and are of a much smaller cross-sectional size than said yarns formed of carbon fibers.

10. A woven textile fabric according to claims 3 or 4 wherein said upper and lower layers of filling yarns are formed of different material from each other so as to provide different characteristics to opposite faces of the fabric.

11. A woven textile fabric according to claim 10 wherein said upper layer of filling yarns is formed of varicolored yarns, and said lower layer of filling yarns and said intermediate layer of straight warp yarns are formed of glass fibers to thereby provide a decorative faced fabric with fire retardant layers therebehind.

12. A woven textile fabric according to claim 10 wherein one of said upper and lower layers of filling yarn is formed of fibers selected from the group consisting of glass fibers, polybenzimidazole fibers, and aramid fibers.

13. A woven textile fabric according to claim 12 wherein said other one of said upper and lower layers of filling yarns is formed of yarns providing an upholstery fabric appearance thereto so that the woven fabric may be used for fire resistant upholstery.

14. A woven textile fabric according to claim 12 wherein said other one of said upper and lower layers of filling yarns is formed of cellulosic fibers for providing wearer comfort as when the fabric is formed into a protective garment with the cellulosic layer forming the inner face of the garment.

15. A method of weaving a multilayered readily movable textile fabric to form superposed upper and lower parallel layers of straight filling yarns and an intermediate layer of straight warp yarns perpendicular to and between the upper and lower of filling yarns, and pairs of cooperating binder warp yarns interconnecting the upper, lower and intermediate layers of yarns, said method comprising directing a group of warp yarns in a substantially straight parallel path of travel and in unison into and through a medial portion of a warp shedding zone while positively feeding a plurality of binder warp yarns forwardly into the warp shedding zone while successively forming warp sheds from the binder yarns, inserting upper and lower filling yarns into the successively formed warp sheds above and below said group of straight warp yarns, closing the successive sheds formed by the binder warp yarns while maintaining the filling yarns in a straight condition, and beating up the upper and lower filling yarns in the shed to thus successively form from the beat up filling yarns the superposed upper and lower parallel layers of straight filling yarns.

16. A method of weaving a textile fabric according to claim 15 including simultaneously inserting the upper and lower filling yarns into the shed and simultaneously beating up the upper and lower filling yarn.

17. A method of weaving a textile fabric according to claim 15 wherein the step of positively feeding a plurality of binder yarns forwardly into the warp shedding zone comprises feeding the binder yarns forwardly in untensioned and relaxed condition to insure that the filling yarns remain in a straight condition in the woven fabric.

18. A method of weaving a textile fabric according to claim 15 wherein said upper and lower filling yarns being inserted are formed of the same material so as to provide the same characteristics to opposite faces of the fabric.

19. A method of weaving a textile fabric according to claim 18 wherein said upper and lower filling yarns being inserted are formed of carbon fibers and wherein the group of warp yarns being directed through the shed is also formed of carbon fibers.

20. A method of weaving a textile fabric according to claim 15 wherein said upper and lower filling yarns being inserted are formed of different material from each other so as to provide different characteristics to opposite faces of the fabric.

21. A method of weaving a textile fabric according to claim 20 wherein one of said upper and lower filling yarns being inserted is selected from the group consisting of glass fibers, polybenzimidazole fibers, and aramid fibers.

22. A method of weaving a textile fabric according to claim 21 wherein the other one of said upper and lower filling yarns being inserted is formed of cellulosic fibers.

23. A method of weaving a textile fabric according to claim 21 wherein the other one of said upper and lower filling yarns is formed of yarns providing an upholstery fabric appearance to the fabric so that the woven fabric may be used for fire resistant upholstery.

24. A method of weaving a textile fabric according to claim 15 including arranging the binder warp yarns in cooperating pairs of an upper and lower binder yarn, and arranging the straight warp yarns forming the intermediate layer so that the same number thereof extend between adjacent pairs of binder yarns.

25. A method of weaving a textile fabric according to claim 24 including arranging the straight warp yarns forming the intermediate layer in side-by-side pairs of yarns with the pairs of binder yarns arranged to extend between the pairs of straight warp yarns.

* * * * *

UNITED STATES PATENT AND TRADEMARK OFFICE

CERTIFICATE OF CORRECTION

PATENT NO. : 4,748,996

DATED : June 7, 1988

INVENTOR(S) : Charles M. Combier

It is certified that error appears in the above-identified patent and that said Letters Patent is hereby corrected as shown below:

Col. 7, line 62, delete "intrevening" and insert --intervening--

Col. 8, line 55, delete "movable" and insert --moldable--

Col. 8, line 59, delete "lower of" and insert --lower layers of--

Signed and Sealed this

Twenty-seventh Day of September, 1988

*Attest:*

DONALD J. QUIGG

*Attesting Officer*

*Commissioner of Patents and Trademarks*